US007868727B2

(12) United States Patent
Chen et al.

(10) Patent No.: US 7,868,727 B2
(45) Date of Patent: Jan. 11, 2011

(54) INTER-HELIX INDUCTOR DEVICES

(75) Inventors: Wei-Ting Chen, Tainan County (TW); Chang-Sheng Chen, Taipei (TW); Chin-Sun Shyu, Pingtung Hsien (TW); Chang-Lin Wei, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 12/133,717

(22) Filed: Jun. 5, 2008

(65) Prior Publication Data

US 2009/0045904 A1 Feb. 19, 2009

(30) Foreign Application Priority Data

Aug. 14, 2007 (TW) ..... 96129949 A

(51) Int. Cl.
*H01F 5/00* (2006.01)
*H01F 27/29* (2006.01)
*H01F 27/28* (2006.01)

(52) U.S. Cl. ..... 336/200; 336/192; 336/222; 336/223

(58) Field of Classification Search ..... None
See application file for complete search history.

(56) References Cited

U.S. PATENT DOCUMENTS 3,757,028 A * 9/1973 Schlessel ..... 174/33
4,641,113 A * 2/1987 Ozawa ..... 333/161
5,039,824 A * 8/1991 Takashima et al. ..... 174/33
5,373,112 A * 12/1994 Kamimura et al. ..... 174/255
5,425,167 A * 6/1995 Shiga et al. ..... 29/606
5,461,353 A * 10/1995 Eberhardt ..... 333/246
5,646,368 A * 7/1997 Muyshondt et al. ..... 174/33
5,696,471 A * 12/1997 Fujiwara ..... 333/177
5,871,655 A * 2/1999 Lee et al. ..... 216/22
5,939,952 A * 8/1999 Noda et al. ..... 333/1
5,977,845 A 11/1999 Kitahara
5,978,231 A 11/1999 Tohya
6,060,976 A * 5/2000 Yamaguchi et al. ..... 336/200
6,608,364 B2 * 8/2003 Carpentier ..... 257/531
6,696,910 B2 2/2004 Nuytkens
7,088,215 B1 * 8/2006 Winter et al. ..... 336/200
7,268,659 B2 * 9/2007 Nishio et al. ..... 336/200
7,420,452 B1 * 9/2008 Lee et al. ..... 336/200
7,495,525 B2 * 2/2009 Ilkov et al. ..... 333/26
2003/0034867 A1 * 2/2003 Berthold et al. ..... 336/200
2003/0210122 A1 * 11/2003 Concord et al. ..... 336/200
2004/0124961 A1 * 7/2004 Aoyagi ..... 336/200
2008/0001698 A1 * 1/2008 Hazucha et al. ..... 336/200

* cited by examiner

*Primary Examiner*—Anh T Mai
*Assistant Examiner*—Mangtin Lian
(74) *Attorney, Agent, or Firm*—Thomas, Kayden, Horstemeyer & Risley

(57) ABSTRACT

The invention is directed to inter-helix inductor devices. The inter-helix inductor device includes a dielectric substrate. An input end is disposed on the first surface of the dielectric substrate. A clockwise winding coil has one end connecting to the input end and at least one winding turn through the dielectric substrate. A counter clockwise winding coil includes at least one winding turn through the dielectric substrate, wherein the clockwise and counter clockwise winding coils are connected by an interconnection. An output end is disposed on the dielectric substrate, connects one end of the counter clockwise winding coil, and is adjacent to the input end.

9 Claims, 12 Drawing Sheets

INTER-HELIX INDUCTOR DEVICES

CROSS REFERENCE TO RELATED APPLICATIONS

This application is based upon and claims the benefit of priority from a prior Taiwanese Patent Application No. 096129949, filed on Aug. 14, 2007, the entire contents of which are incorporated herein by reference.

BACKGROUND OF THE INVENTION

1. Field of the Invention

The invention relates to embedded inductor devices, and in particular to three dimensional inter-helix inductor devices with high quality factor.

2. Description of the Related Art

Embedded inductor devices have been applied in various circuits including resonators, filters, and matching networks. Among applications of wireless communication, digital computers, portable electronics, and information household appliances, product features with higher frequencies, broader bandwidths, and miniaturization have become main requirements by those associated with the high-tech industry and commercial markets.

For a system module, inductor devices are considered as a divide for radio frequency (RF) application and digital application. Applied in an RF module, conventional inductor devices are dependent from RF circuit matching and energy loss. The decisive parameters affecting inductor performance are self-resonance frequency (SRF) and quality factor. High self-resonance frequency can broaden operational band of the inductor device, while high quality factor can reduce signal transmission losses. Since the inductor devices are operated at high self-resonance frequency, characteristics of the inductor devices are changed and dominated by capacitance response. This can severely affect characteristics and performance of a circuit and a system module. Therefore, a need exists to reduce parasitic effect on the inductor or design of a novel inductor structure.

Typically, quality factor of inductor devices can be defined as shown in Eq. 1. More specifically, quality factor means the ratio of storage energy to dissipate energy during a periodic cycle.

$$Q = \frac{2\pi \times \text{The maximum stored energy}}{\text{The energy dissipated per cycle}} \qquad \text{Eq. 1}$$

The quality factor of an inductor device can be acquired by band width measurement, as expressed by Eq. 2.

$$Q = F_0/\Delta F;\ F_0\text{: Operation frequency } \Delta F\text{: 3 dB bandwidth} \qquad \text{Eq. 2}$$

Further, the quality factor of a inductor device is dependent from the equivalent series resistance (ESR) thereof. If the ESR is relatively small, the quality factor will increase for the same inductor mechanism. Moreover, distribution of electromagnetic field can also affect the quality factor of the inductor device. Surface roughness and process variations can also affect the quality factor of the inductor device.

When designing an embedded inductor device, therefore, considerations include desirable inductance of the embedded inductor device, grounding effect on the embedded inductor device, or electromagnetic field distribution. Conventional embedded inductor devices usually utilize large circuit layout area to achieve desirable inductance characteristics. On the other hand, when designing two-port inductor devices, circuit layout complexity become perplexed due to a far distance between input end and output end. The circuit layout area is also relatively increased. Moreover, since complexity of advanced communication system is continuing to increase, more inductor devices are needed to maintain circuit performance. Thus, improved embedded inductor devices are being demanded, but still elude those skilled in the art who are unable to meet demands and reduce circuit layout area and production costs.

U.S. Pat. No. 5,461,353, the entirety of which is hereby incorporated by reference, discloses a tunable embedded inductor device. Referring to FIG. 1, a tunable coil 10 is embedded in a multi-layered substrate structure. A transistor 18 is controlled by a control signal from a control line 15 to electrically short two adjacent conductive interconnections 14 and 16, thereby regulating inductance of the coil 10. Metal layers, functioning as shielding inductance, are disposed on the top and bottom of the multi-layered substrate structure, respectively. The advantageous feature of the tunable embedded inductor device is turning inductance with superb quality factor due to distribution of electromagnetic field confined within the spiral coil. Large circuit layout area, however, is needed to achieve coils with high inductance. Since the input end and the output end of the coil are separated by a very far distance, a very large circuit layout area is required for fabricating the two-port inductor device.

Further, U.S. Pat. No. 5,978,231, the entirety of which is hereby incorporated by reference, discloses an integrated coil inductor device. A magnetic material is pressed between two substrates, and a spiral inductor structure is formed on the magnetic material. Inductance of the spiral inductor structure is thus improved. FIG. 2A is a plan view of a conventional integrated coil inductor device, and FIG. 2B is a cross section of the integrated coil inductor device of FIG. 2A. Referring to FIGS. 2A and 2B, an integrated coil inductor includes a magnetic material layer s and interposed substrates. An embedded spiral inductor is disposed on the magnetic material layer s. The embedded spiral inductor is a coil structure consisting of conductive layers 29, 30 and conductive interconnection 28. More specifically, the coil structure includes conductive segments 29*a*, 29*b* and 30*a*, 30*b* disposed on both side of the magnetic material layer s, respectively. The conductive segments 29*a*, 29*b* and 30*a*, 30*b* are connected by conductive interconnections 28*a*-28*e* winding an embedded spiral inductor. Since the magnetic material is wound by the embedded spiral coil, relative large inductance can thus be acquired. Further, since stronger electromagnetic flux is distributed in the embedded spiral coil, improved quality factor can also be achieved. Conventional two-port integrated inductors, however, have a large distanced input end and output end, thereby increasing circuit layout area, which hinders integration with other active and passive devices.

U.S. Pat. No. 6,696,910, the entirety of which is hereby incorporated by reference, discloses a two-layered planar inductor structure. Referring to FIG. 3, a two-layered planar inductor device 50 includes a circuit board 54 and a ground plane 64 disposed on the circuit board 54. Screw holes 75, 76 are disposed at the peripheral region of the circuit board 54. An embedded spiral inductor 52 includes a winding 58 and conductive interconnection 62 disposed in the central region of the circuit board 54. A high relative permeability material is used as a core of the spiral inductor 52, and the inductor device can thus serve as a transformer. Other circuit elements

68, 70, 72 and 74, such as conductive lines and conductive interconnections 66 are further arranged on the circuit board 54.

The inductance of the conventional two-layered planar inductor devices is affected by core magnetic material. The inductance can be improved. The electromagnetic field concentrated within the spiral inductor can have excellent quality factor. The inductor device thus formed, however, still cannot reduce the circuit layout area even if the input and output ends are disposed closer together.

BRIEF SUMMARY OF THE INVENTION

The invention provides a three-dimensional inter-helix spiral inductor structure. Circuit layout problems due to far distance between the first terminal and the second terminal of the conventional two-port inductor device can be effectively solved. The inductor device can facilitate integration with other active and passive devices. The electromagnetic flux distribution can be concentrated with a stereographical winding coil structure, thereby reducing loss of electromagnetic radiation, reducing requirement of energy and further achieve excellent quality factor.

Embodiments of the invention provide an inter-helix inductor device, comprising: a dielectric substrate; a first terminal disposed on the first surface of the dielectric substrate; a clockwise winding coil with one end connecting the first terminal and with at least one winding turn through the dielectric substrate; a counter clockwise winding coil having at least one winding turn through the dielectric substrate, wherein the clockwise and counter clockwise winding coils are connected by an interconnection; and a second terminal disposed on the dielectric substrate, connecting one end of the counter clockwise winding coil, and being adjacent to the first terminal.

Embodiments of the invention further provide an inter-helix inductor device, comprising: a dielectric substrate; a first terminal disposed on the first surface of the dielectric substrate; a first inter-helix spiral coil comprising: a first clockwise winding coil with one end connecting to the first terminal and with at least one winding turn through the dielectric substrate; and a first counter clockwise winding coil having at least one winding turn through the dielectric substrate, wherein the first clockwise and first counter clockwise winding coils are connected by a first interconnection. The inter-helix inductor device further comprises a second inter-helix spiral coil comprising: a second clockwise winding coil with at least one winding turn through the dielectric substrate; and a second counter clockwise winding coil having at least one winding turn through the dielectric substrate, wherein the second clockwise and second counter clockwise winding coils are connected by a second interconnection. The inter-helix inductor device further comprises a third interconnection connecting the first inter-helix spiral coil and the second inter-helix spiral coil. A second terminal is disposed on the dielectric substrate. The second terminal connects one end of the second counter clockwise winding coil. The second terminal is adjacent to the first terminal.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
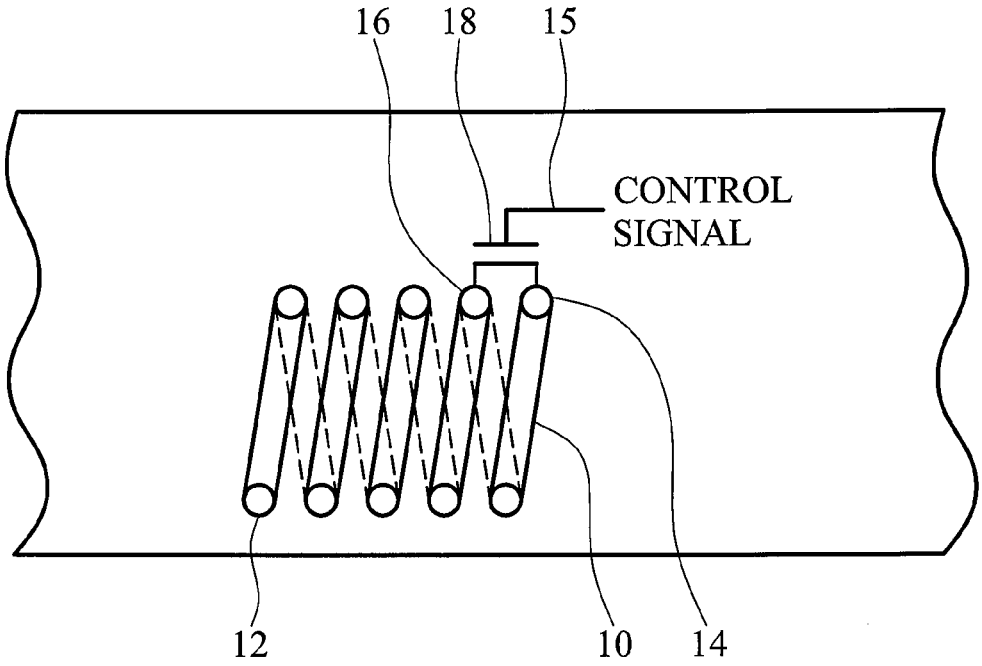
FIG. 1 ( PRIOR ART )
FIG. 1 is a schematic view of a conventional tunable inductor device.
Figure 2A:
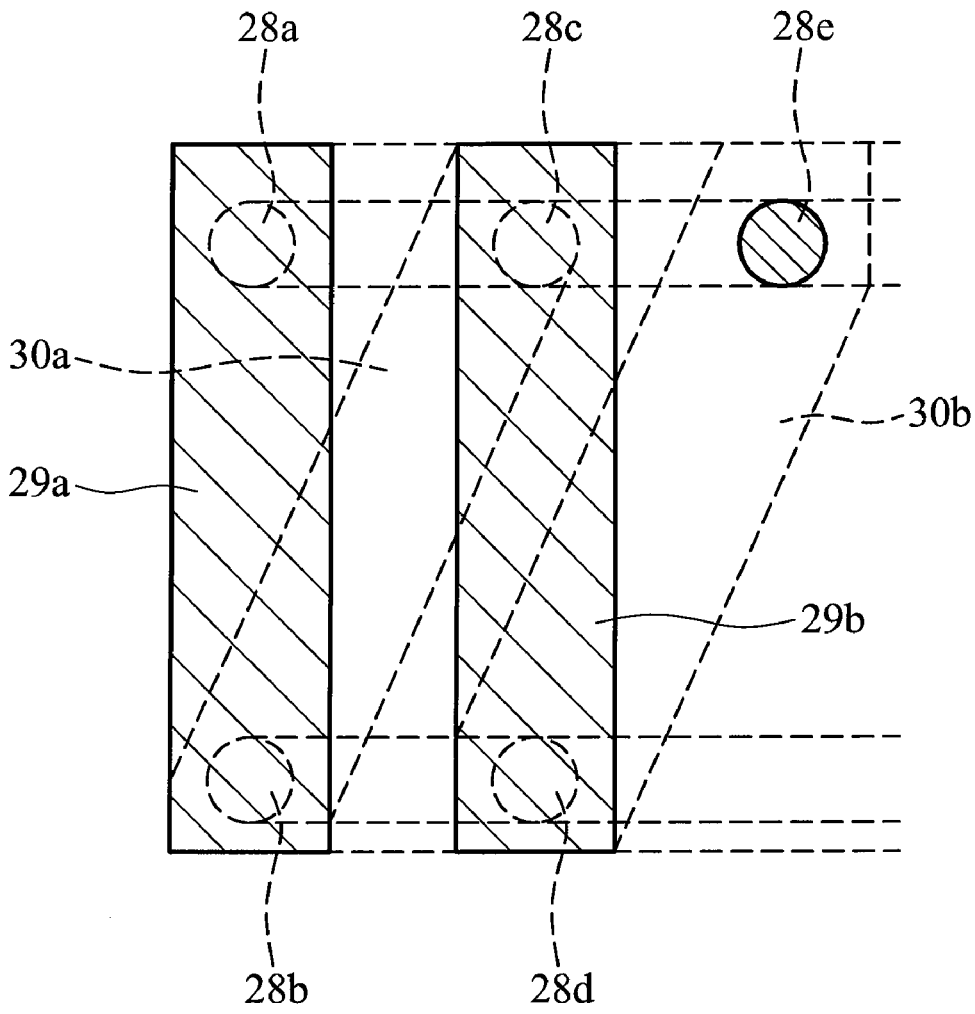
FIG. 2A ( PRIOR ART )
FIG. 2A is a plan view of a conventional integrated coil inductor device.
Figure 2B:
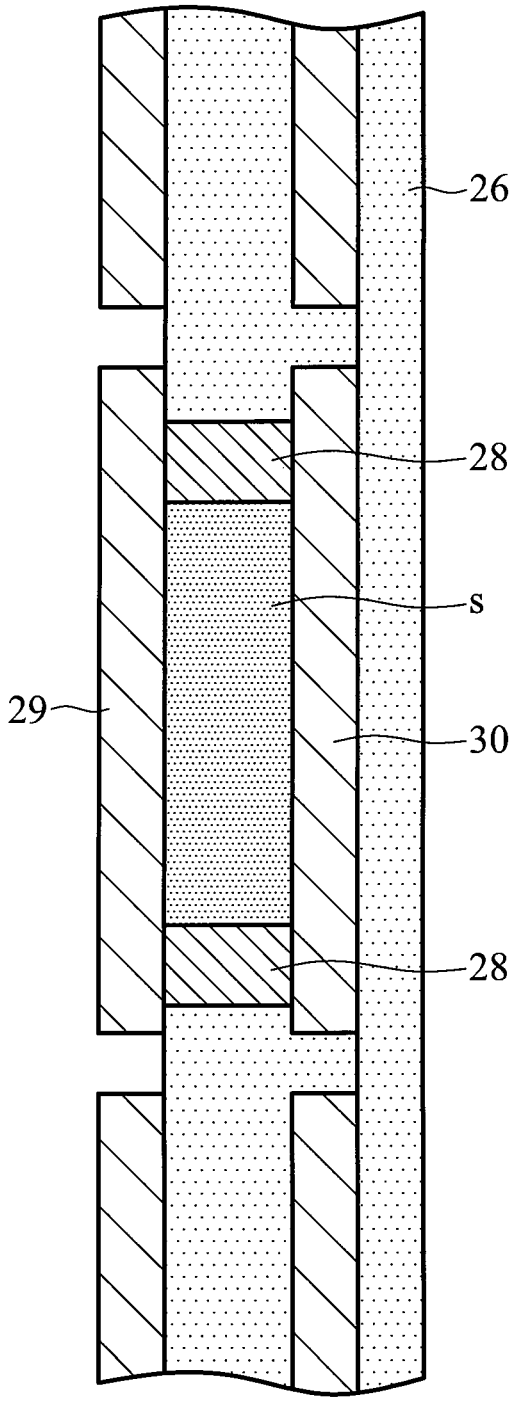
FIG. 2B ( PRIOR ART )
FIG. 2B is a cross section of the integrated coil inductor device of FIG. 2A.
Figure 3:
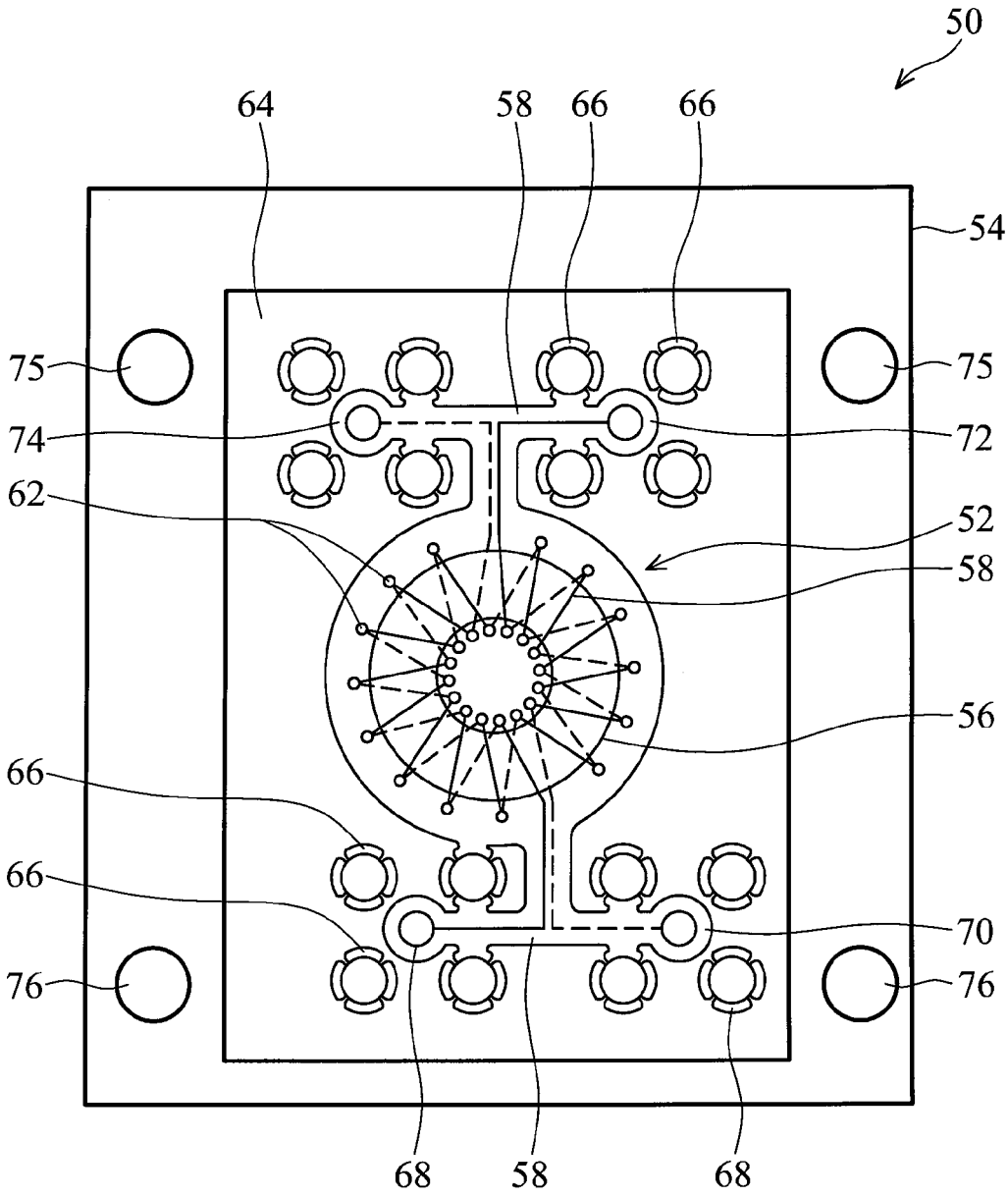
FIG. 3 ( PRIOR ART )
FIG. 3 is a plan view of a conventional double-layered inductor device structure.

It is to be understood that the following disclosure provides many different embodiments, or examples, for implementing different features of various embodiments. Specific examples of components and arrangements are described below to simplify the present disclosure. These are merely examples and are not intended to be limiting. In addition, the present disclosure may repeat reference numerals and/or letters in the various examples. This repetition is for the purpose of simplicity and clarity and does not in itself indicate a relationship between the various embodiments and/or configurations discussed. Moreover, the formation of a first feature over or on a second feature in the description that follows may include embodiments in which the first and second features are formed in direct contact or not in direct contact.

Figure 4:
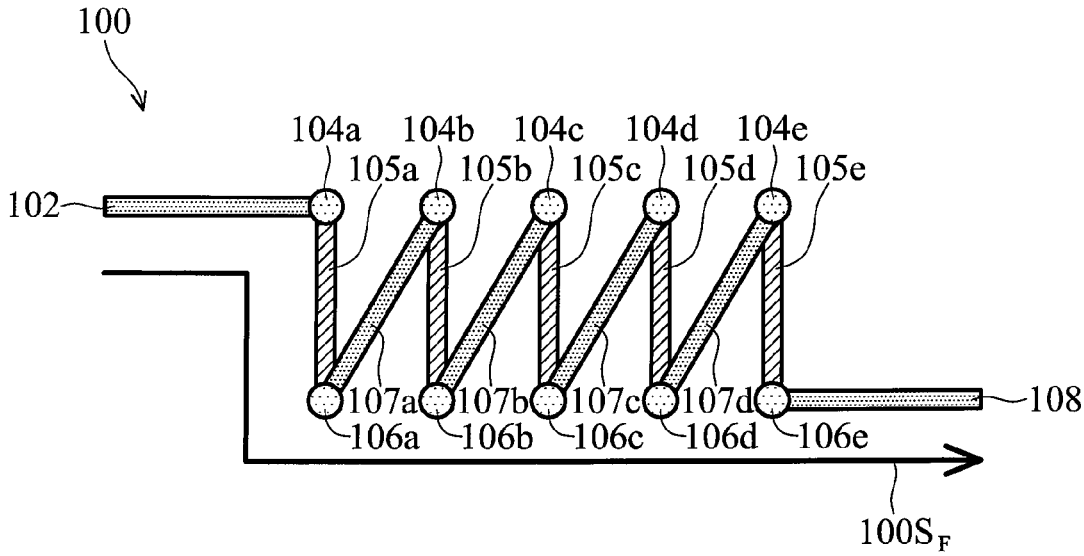
FIG. 4 is a plan view of a spiral inductor structure.

FIG. 4 is a plan view of a spiral inductor structure. A spiral inductor device 100 includes a first terminal 102 (e.g., an input end) connecting a spiral winding coil, and further connecting to a second terminal 108 (e.g., an output end). The spiral winding coil includes conductive segments 105*a*-105*e* and 107*a*-107*d* disposed on both sides of a dielectric substrate, respectively. Conductive segments 105*a*-105*e* and 107*a*-107*d* are connected by interconnections 104*a*-104*e* and 106*a*-106*e*, respectively, thereby creating a clockwise winding spiral coil and a counter-clockwise winding spiral coil. The first terminal 102 (e.g., an input end) and the second terminal 108 (e.g., an output end) of the spiral inductor device 100 are respectively disposed on two sides of the spiral coil. If the spiral coil layout is arranged as a two-port inductor device, the input and output ends are disposed apart from each other, consuming lots of circuit layout area, thus hindering integration with other circuitry devices. Therefore, a desirable inter-helix inductor device should effectively reduce layout area requirement and achieve high quality factor characteristic. During operation, signals $\mathbf{100}S_F$ are fed in the first terminal 102 (e.g., an input end) passing through the spiral coil inductor, and is further transmitted to the second terminal 108 (e.g., an output end).

According to an embodiment of the invention, the spiral inductor device 100 uses crossed layout transmission lines disposed on different layers of substrate. Each transmission line is connected to each other by interconnections, thereby creating an embedded stereographic inter-helix inductor structure. The input and output ends of the two-port inter-helix inductor structure are arranged closer to each other, thereby effectively reducing circuit layout area requirement and providing more design margins for system circuit layout. Further, the embedded stereographic inductor can concentrate electromagnetic field distribution in the central region of the inter-helix spiral coil, thereby reducing electromagnetic radiation and energy loss and improving quality factor.

Figure 5:
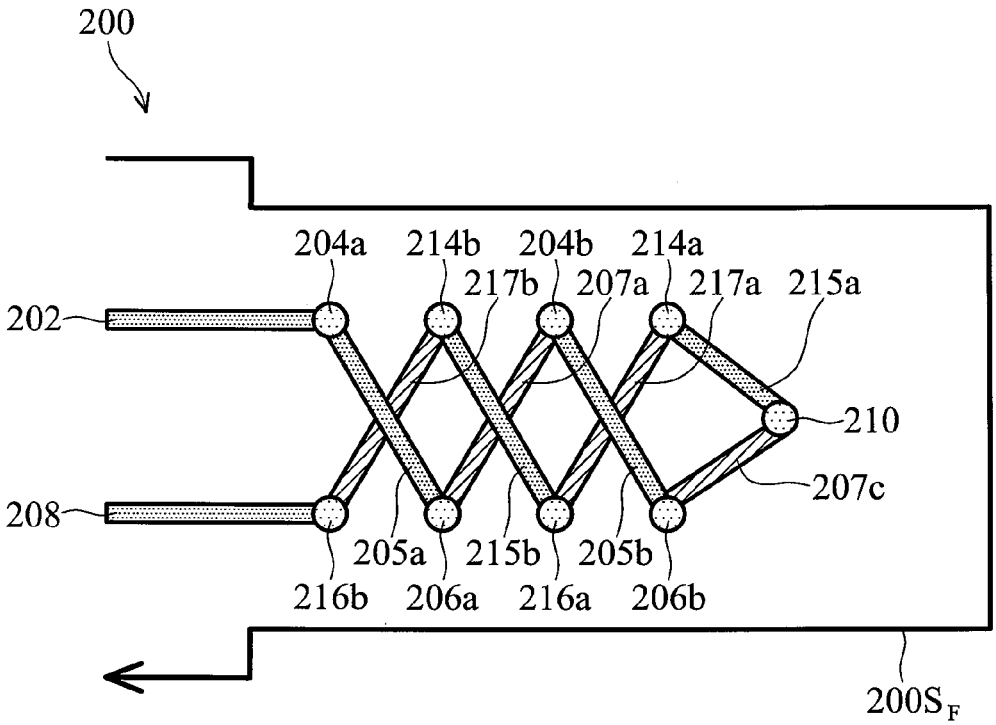
FIG. 5 is a plan view of an embodiment of a inter-helix spiral inductor structure of the invention.
Figure 6:
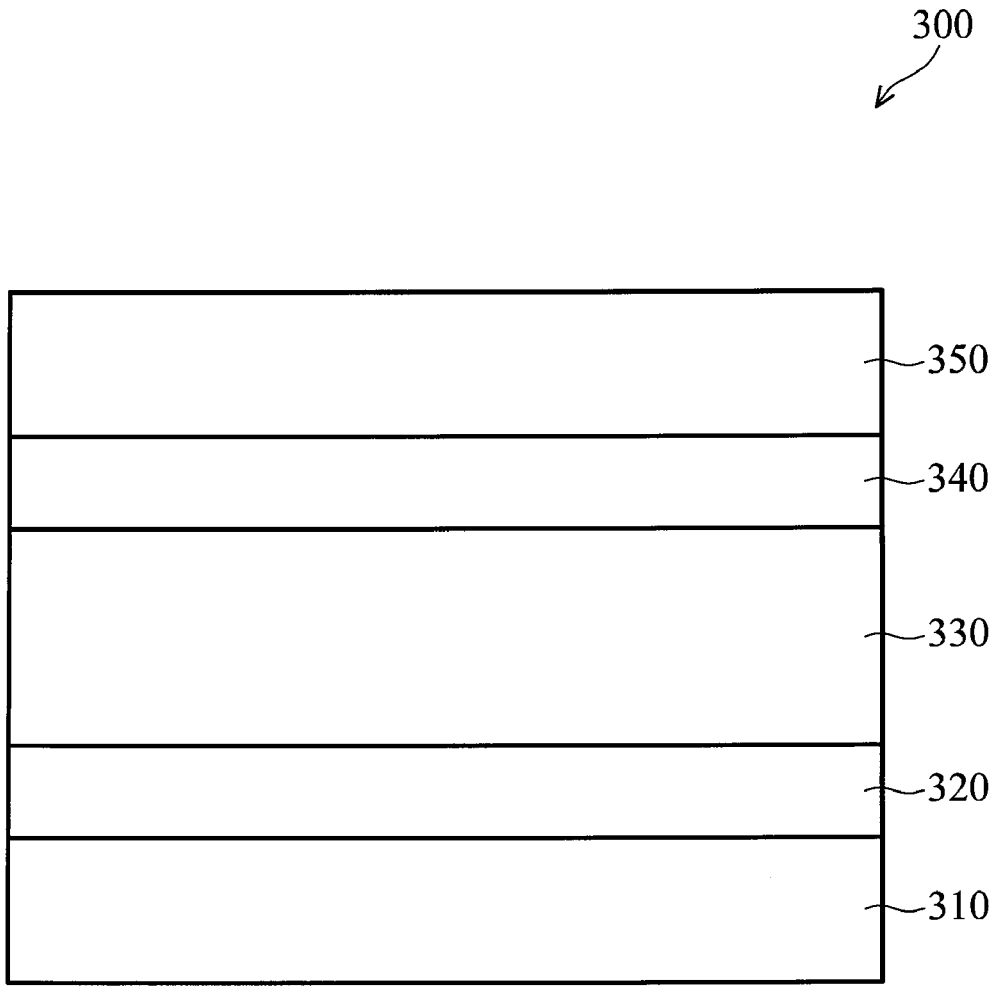
FIG. 6 is a schematic view of an embodiment of the dielectric substrate of the invention.

FIG. 5 is a plan view of an embodiment of a inter-helix spiral inductor structure of the invention. Referring to FIG. 5, an inter-helix spiral inductor device 200 includes dielectric substrates 300 as shown in FIG. 6, and a first terminal 202 (e.g., an input end) disposed on the dielectric substrates. A clockwise winding conductive coil connecting the first terminal 202 with at least one winding turn surrounds the dielectric substrates. The clockwise winding conductive coil includes conductive segments 205*a*, 205*b* and 207*a*, 207*c* disposed on both sides of the dielectric substrates, respectively. Conductive segments 205*a*, 205*b* and 207*a*, 207*c* are connected by first interconnections 204*a*, 204*b* and 206*a*, 206*b*, respectively.

A counter-clockwise winding conductive coil has at least one winding turn surrounding the dielectric substrates. The counter-clockwise winding conductive coil includes conductive segments 215*a*, 215*b* and 217*a*, 217*b* disposed on both sides of the dielectric substrates, respectively. Conductive segments 215*a*, 215*b* and 217*a*, 217*b* are connected by second interconnections 214*a*, 214*b* and 216*a*, 216*b*, respectively. The clockwise winding and counter-clockwise winding conductive coils are connected by a third interconnection 210. A second terminal 208 (e.g., an output end) connects the counter-clockwise winding conductive coil and is adjacent to the first terminal 202 (e.g., an input end). During operation, signals 200$S_F$ are fed in the first terminal 202 (e.g., an input end) passing sequentially through the clockwise winding conductive coil, the third interconnection 210, and the counter-clockwise winding conductive coil, and is further transmitted to the second terminal 208 (e.g., an output end). Since the transmission lines (conductive segments) are crossed over on the upper and lower layers of the dielectric substrate (i.e., the transmission lines can be disposed on different layers), the input and output signals can be transmitted on the same route. Note that the first terminal 202 (e.g., an input end) of the inter-helix inductor device is adjacent to the second terminal 208 (e.g., an output end) such that the circuit layout area can thus be reduced, thereby improving integration with other active and passive devices and providing more design margins for system circuit layout.

FIG. 6 is a schematic view of an embodiment of the dielectric substrate of the invention. A suitable dielectric substrate for embodiment of the invention comprises multi-layered substrates 300. The inter-helix spiral inductor 200 is embedded in the multi-layered substrates 300. For example, the multi-layered substrates 300 includes a first dielectric layer 310 (e.g., 4 mil RO4403 dielectric material), a second dielectric layer 320 (e.g., 2 mil high dielectric constant material HiDK 20), a third dielectric layer 330 (e.g., 12 mil BT), a fourth dielectric constant layer 340 (e.g., 2 mil HiDK 20), and a fifth dielectric layer 350 (e.g., 4 mil RO4403). The dielectric substrate comprises a polymer substrate, a ceramic substrate, or a semiconductor substrate, and the dielectric substrate can be made of a singular material or a composite-substrate 411 made of multiple materials. Moreover, the dielectric substrate comprises a circuit 480 with at least one active device 470 or passive device 480, as shown in FIG. 7A.

Figure 7A:
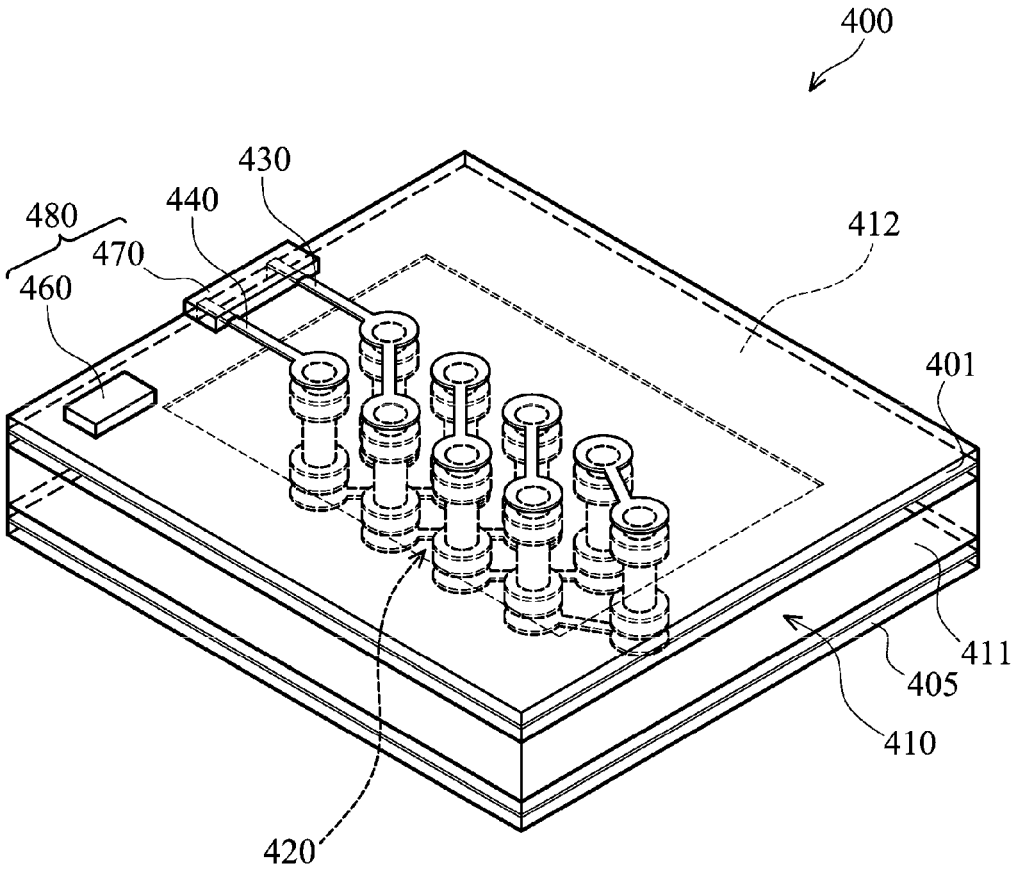
FIG. 7A is stereographical view of an embodiment of the inter-helix inductor devices of the invention.
Figure 7B:
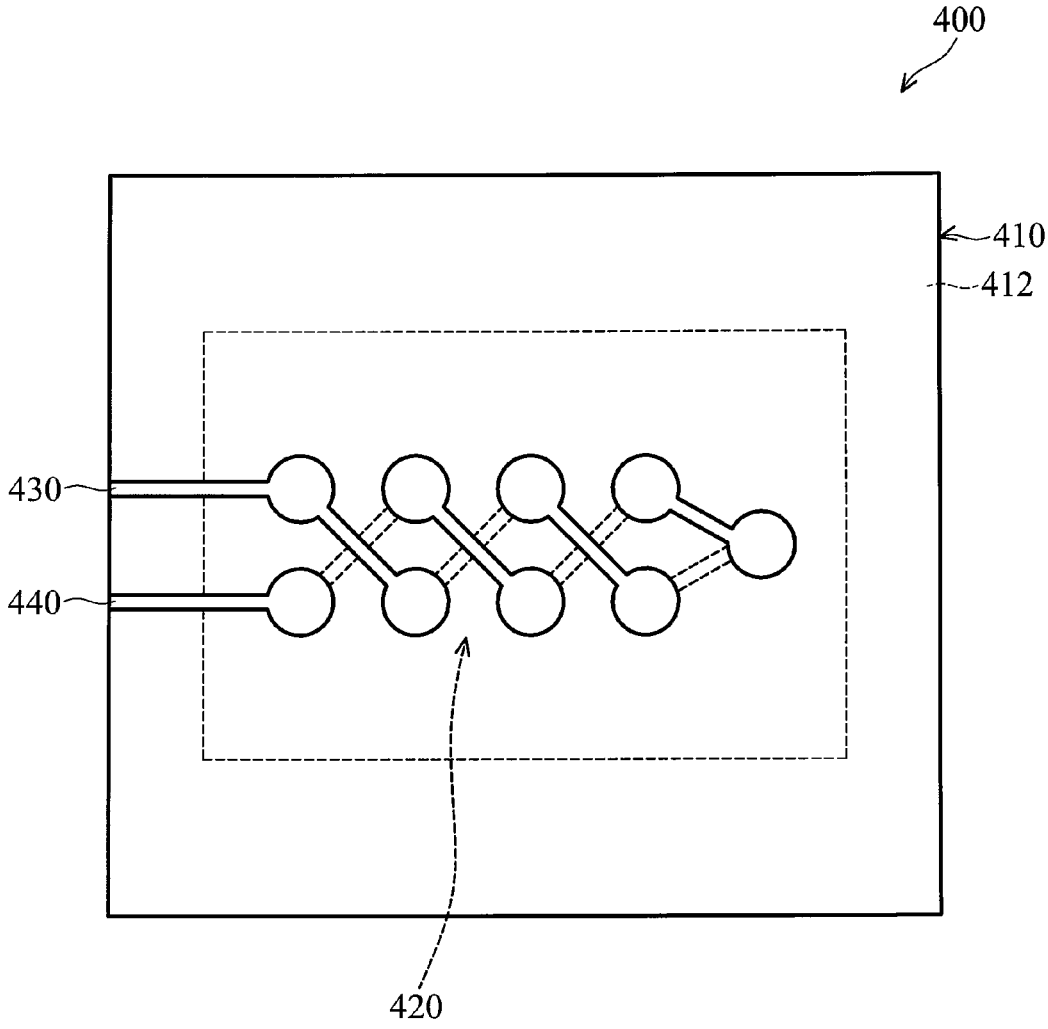
FIG. 7B is a plan view of the inter-helix inductor devices of FIG. 7A.

FIG. 7A is stereographical view of an embodiment of the inter-helix inductor devices of the invention, and FIG. 7B is a plan view of the inter-helix inductor devices of FIG. 7A. Referring to FIG. 7A, the inter-helix inductor device 400 includes an inter-helix winding coil 420 embedded in the multi-layered dielectric substrates 410. The inter-helix winding coil 420 can be embedded in the single-layered dielectric substrates 411 made of a singular material. A first terminal 430 (e.g., an input end) and a second terminal 440 (e.g., an output end) are disposed on the dielectric substrates 410. Ground lines 412 are disposed at the peripheral area of the inter-helix inductor device 400. The inter-helix inductor device 400 further includes a bottom layer 405 disposed underlying the dielectric substrate 410 and a top layer 401 disposed overlying the dielectric substrate 410 respectively, wherein the interconnection is formed by a stacking hole process comprising a through hole process, a blind hole process, or a buried hole process and is formed between different dielectric layers.

Note that according embodiments of the invention a cap layer can be optionally formed covering the dielectric substrates 410. Alternatively, a bottom layer can be optionally formed underlying the back of the dielectric substrates 410. More specifically, interconnections between different layers can be formed by different stacking hole processes comprising a through hole process, a blind hole process, or a buried hole process to complete the inter-helix inductor structure.

Figure 8A:
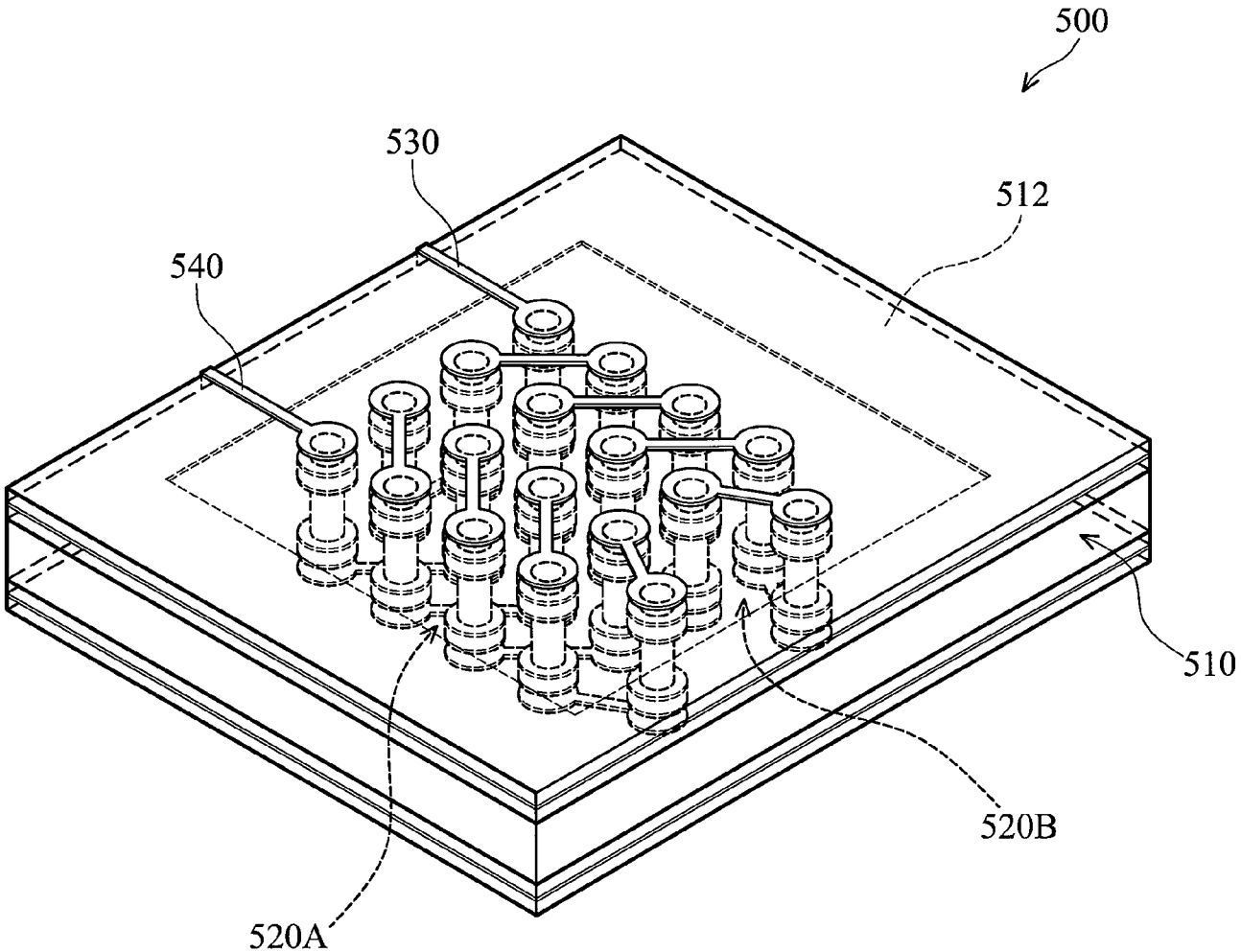
FIG. 8A is stereographical view of another embodiment of the double inter-helix inductor devices of the invention.
Figure 8B:
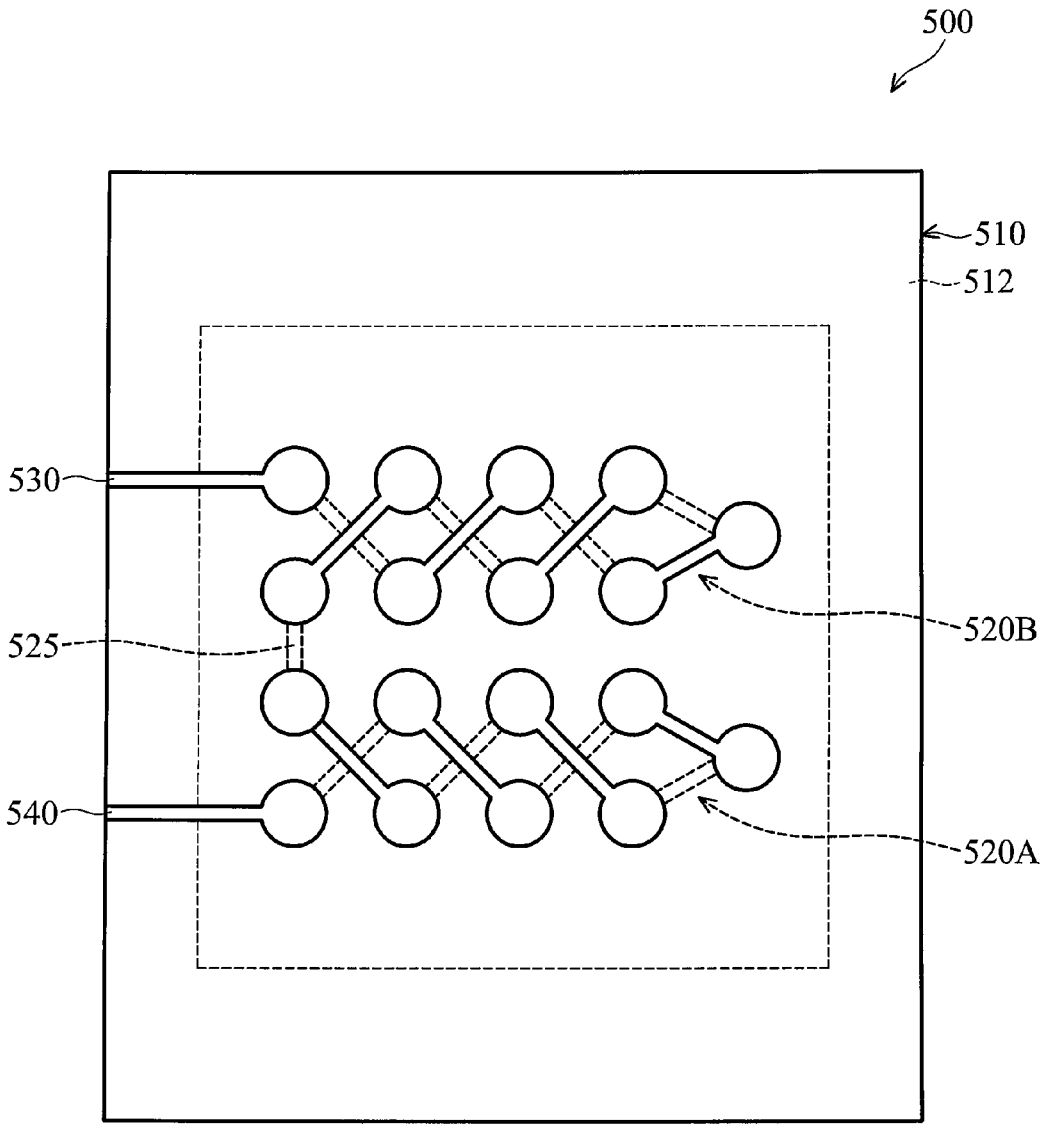
FIG. 8B is a plan view of the double inter-helix inductor devices of FIG. 8A.

FIG. 8A is stereographical view of another embodiment of the double inter-helix inductor devices of the invention, and FIG. 8B is a plan view of the double inter-helix inductor devices of FIG. 8A. Referring to FIG. 8A, the double inter-helix inductor device 500 includes a first inter-helix winding coil 520A and a second inter-helix winding coil 520B embedded in the multi-layered dielectric substrates 510. The first and second inter-helix winding coils 520A and 520B are connected by an interconnection 525. A first terminal 530 (e.g., an input end) is connected to the first inter-helix winding coil 520A, and a second terminal 540 (e.g., an output end) is connected to the second inter-helix winding coil 520B. Both the first and second terminals 530 and 540 are disposed on the dielectric substrates 510. Ground lines (planes) 512 are disposed at the peripheral area of the double inter-helix inductor device 500.

Figure 9A:
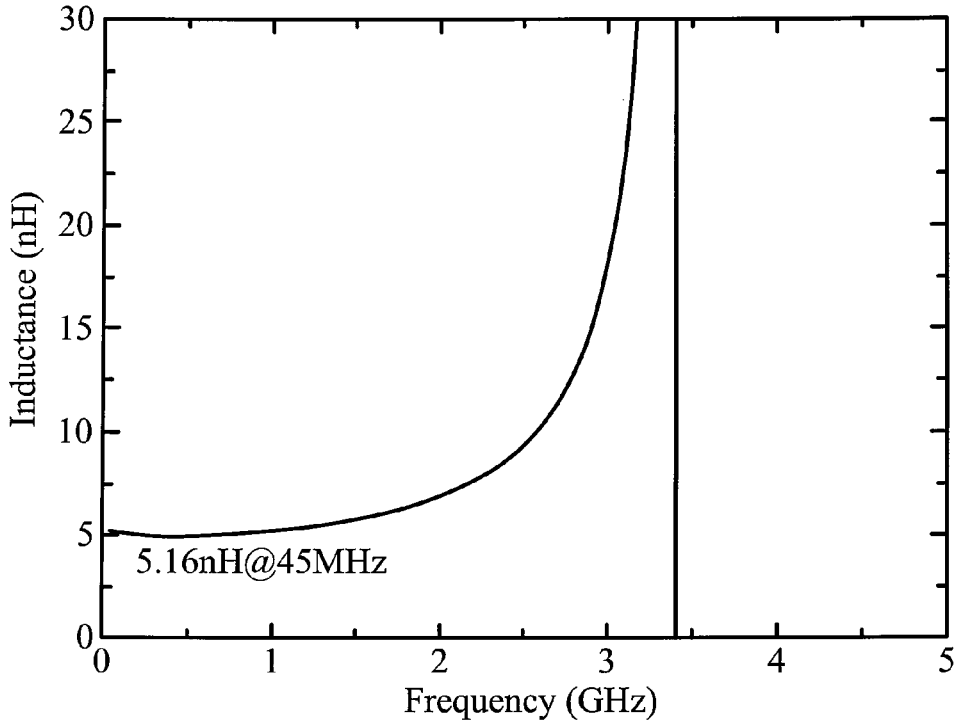
FIG. 9A shows relationship between inductance and frequency of the inter-helix inductor device in accordance with embodiments of the invention.
Figure 9B:
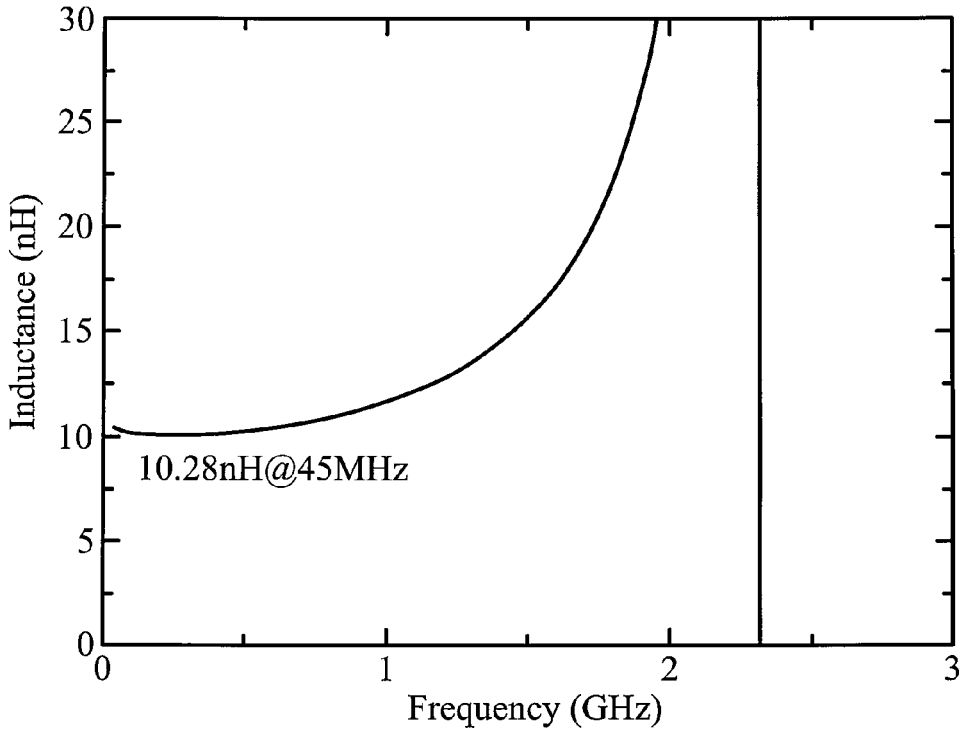
FIG. 9B shows relationship between inductance and frequency of the double inter-helix inductor device in accordance with embodiments of the invention.
Figure 10A:
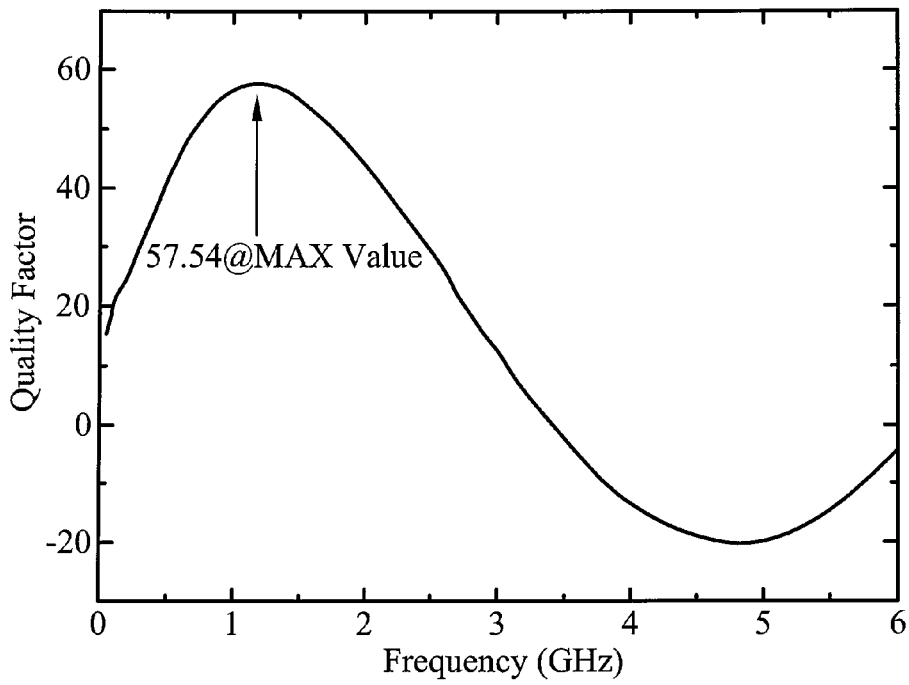
FIG. 10A shows relationship between the maximum quality factor and frequency of the inter-helix inductor device in accordance with embodiments of the invention.
Figure 10B:
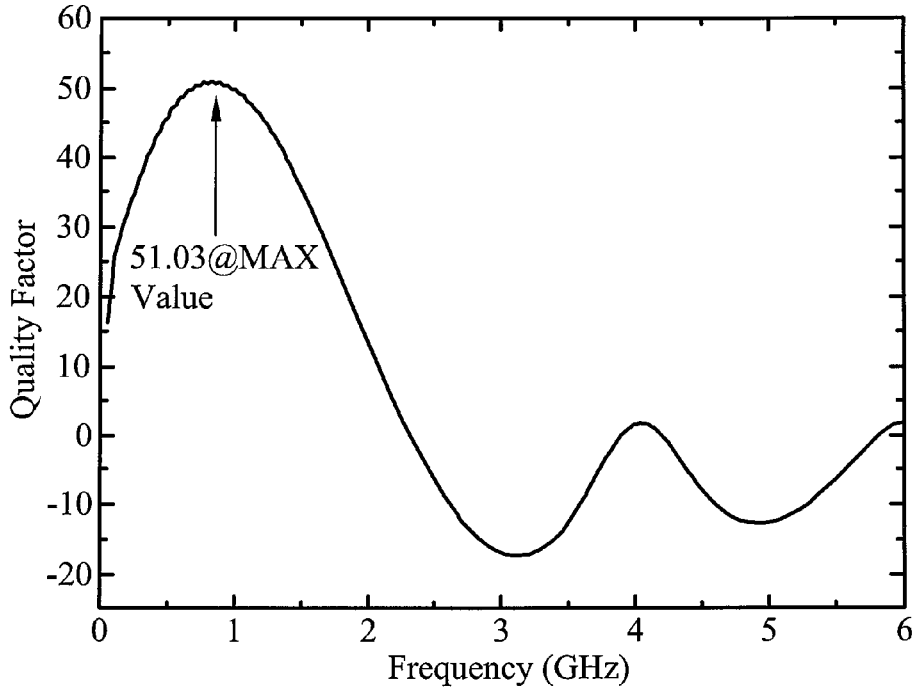
FIG. 10B shows relationship between the maximum quality factor and frequency of the double inter-helix inductor device in accordance with embodiments of the invention.

FIG. 9A shows relationship between inductance and frequency of the inter-helix inductor device in accordance with embodiments of the invention, and FIG. 9B shows relationship between inductance and frequency of the double inter-helix inductor device in accordance with embodiments of the invention. Referring to FIGS. 9A and 9B, the inductance of the inter-helix inductor device 400 is about 5.16 nH at 45 MHz. On the contrary, the inductance of the double inter-helix inductor device 500 is about 10.28 nH at 45 MHz. Further, referring to FIGS. 10A and 10B, the maximum quality factor of the inter-helix inductor device 400 is about 57.54, while the maximum quality factor of the double inter-helix inductor device 500 is about 51.03. Therefore, the inductance of the double inter-helix inductor device 500 can be double that of the single inter-helix inductor device without affecting the maximum quality factor.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An inter-helix inductor device, comprising:

a multi-layered dielectric substrate;

a first terminal disposed on the first surface of the dielectric substrate;

a first inter-helix spiral coil comprising:

a first clockwise winding coil with one end connecting to the first terminal and with at least one winding turn through the multi-layered dielectric substrate; and a first counter clockwise winding coil having at least one winding turn through the multi-layered dielectric substrate and inter-wound with the first clockwise winding coil, wherein the first clockwise and first counter clockwise winding coils are connected by a first interconnection;

a second inter-helix spiral coil comprising:

a second clockwise winding coil with at least one winding turn through the multi-layered dielectric substrate; and a second counter clockwise winding coil having at least one winding turn through the multi-layered dielectric substrate and inter-wound with the second clockwise winding coil, wherein the second clockwise and second counter clockwise winding coils are connected by a second interconnection;

a third interconnection connecting the first inter-helix spiral coil and the second inter-helix spiral coil; and a second terminal disposed on the dielectric substrate, connecting one end of the second counter clockwise winding coil, and being adjacent to the first terminal, wherein the first, the second and the third interconnections pass through the multi-layered dielectric substrate.

2. The inter-helix inductor device as claimed in claim 1, wherein the multi-layered dielectric substrate comprise a composite-substrate made of multiple materials.

3. The inter-helix inductor device as claimed in claim 1, wherein the multi-layered dielectric substrate comprises a polymer substrate, a ceramic substrate, or a semiconductor substrate.

4. The inter-helix inductor device as claimed in claim 1, wherein the multi-layered dielectric substrate comprises multiple layers of dielectric layers.

5. The inter-helix inductor device as claimed in claim 4, further comprising a bottom layer disposed underlying the multi-layered dielectric substrate, wherein the first, second, and third interconnections are formed by a stacking hole process comprising a through hole process, a blind hole process, or a buried hole process and is formed between different dielectric layers.

6. The inter-helix inductor device as claimed in claim 4, further comprising a top layer disposed overlying the multi-layered dielectric substrate, wherein the first, second, and third interconnections are formed by a stacking hole process comprising a through hole process, a blind hole process, or a buried hole process and is formed between different dielectric layers.

7. The inter-helix inductor device as claimed in claim 4, further comprising a bottom layer disposed underlying the multi-layered dielectric substrate and a top layer disposed overlying the multi-layered dielectric substrate respectively, wherein the first, second, and third interconnections are formed by a stacking hole process comprising a through hole process, a blind hole process, or a buried hole process and is formed between different dielectric layers.

8. The inter-helix inductor device as claimed in claim 1, wherein the multi-layered dielectric substrate comprises a circuit with at least one active device or passive device.

9. The inter-helix inductor device as claimed in claim 1, wherein the first terminal is an input end, and the second terminal is an output end.

* * * * *